US008191213B2

(12) United States Patent
Anscher

(10) Patent No.: US 8,191,213 B2
(45) Date of Patent: Jun. 5, 2012

(54) QUICK RELEASE BUCKLE ASSEMBLY

(75) Inventor: Joseph Anscher, Muttontown, NY (US)

(73) Assignee: National Molding LLC, Miami Lakes, FL (US)

( * ) Notice: Subject to any disclaimer, the term of this patent is extended or adjusted under 35 U.S.C. 154(b) by 291 days.

(21) Appl. No.: 12/661,308

(22) Filed: Mar. 15, 2010

(65) Prior Publication Data

US 2011/0219590 A1 Sep. 15, 2011

(51) Int. Cl.
*A44B 11/25* (2006.01)

(52) U.S. Cl. ..... 24/647; 24/606; 24/614; 24/648

(58) Field of Classification Search ..... 24/606, 24/634, 633, 636, 641, 646, 648, 647
See application file for complete search history.

(56) References Cited

U.S. PATENT DOCUMENTS

| | | | | |
|---|---|---|---|---|
| 3,200,463 | A | 8/1965 | Craven et al. | |
| 4,679,282 | A * | 7/1987 | Feng | 24/614 |
| 4,795,385 | A * | 1/1989 | Matsuoka | 441/64 |
| 4,914,790 | A * | 4/1990 | Foubert | 24/658 |
| 5,275,437 | A | 1/1994 | Moedinger et al. | |
| 5,465,472 | A | 11/1995 | Matoba | |
| 5,561,891 | A * | 10/1996 | Hsieh | 24/581.1 |
| 5,832,573 | A | 11/1998 | Howell | |
| 5,893,199 | A * | 4/1999 | Anscher | 24/625 |
| 6,185,794 | B1 * | 2/2001 | Maggi | 24/170 |
| 6,463,640 | B1 * | 10/2002 | Toth | 24/648 |
| 6,487,761 | B2 | 12/2002 | Van Tassel | |
| 6,678,925 | B1 * | 1/2004 | Howell | 24/647 |
| 6,769,137 | B2 | 8/2004 | D'Annunzio | |
| 7,047,570 | B2 | 5/2006 | Johnson | |
| 7,073,234 | B2 | 7/2006 | Turpin | |
| 7,096,545 | B2 | 8/2006 | Uehara et al. | |
| 7,107,657 | B1 * | 9/2006 | Howell | 24/614 |
| 7,155,786 | B2 * | 1/2007 | Grimm | 24/647 |
| 7,243,376 | B2 | 7/2007 | Johnson | |
| 7,424,748 | B1 | 9/2008 | McDunn et al. | |
| 7,448,116 | B1 * | 11/2008 | Howell | 24/614 |

FOREIGN PATENT DOCUMENTS

| | | |
|---|---|---|
| DE | 1 849 648 | 4/1962 |
| DE | 10 2007 058 124 | 6/2009 |
| WO | WO 2008/094280 | 8/2008 |
| WO | WO 2009/047790 | 4/2009 |

OTHER PUBLICATIONS

European Search Report dated Aug. 20, 2010.

* cited by examiner

*Primary Examiner* — Robert J Sandy
*Assistant Examiner* — Rowland D Do
(74) *Attorney, Agent, or Firm* — Collard & Roe, P.C.

(57) ABSTRACT

A quick release buckle assembly has a male portion and a female portion. The female portion has a hollow body and at least one locking slot. The male portion has a base with at least one locking leg, such that inserting the male portion into the female portion causes the locking leg to engage the locking slot to lock the male portion to the female portion. The male portion has a lever pivotably connected to the male portion, and a free end with a tongue extending into an interior of the male portion. The male portion has an engaging element connected to a free end of the locking legs and contacting the tongue, so that lifting the free end of the lever causes the tongue to push the engaging element toward the base of the male portion and move the locking legs inward to release the male portion from the female portion.

7 Claims, 6 Drawing Sheets

QUICK RELEASE BUCKLE ASSEMBLY

BACKGROUND OF THE INVENTION

1. Field of the Invention

This invention relates to a quick release buckle system. In particular, the invention relates to a quick-release buckle system that can be used on articles that need to be quickly and easily removed by the user.

2. The Prior Art

Standard two-part buckle systems usually require the user to squeeze two legs of the male buckle portion in order to release the male portion from the female portion. However, this often cannot be easily done if the buckle is to be disengaged while the user is moving. There have been several attempts to devise a buckle assembly that can be unlocked very quickly and easily, even when the user is moving.

U.S. Pat. No. 6,487,761 to Van Tassel, the disclosure of which is herein incorporated by reference, shows a buckle assembly that can be disengaged by pulling on a cord connected to the male buckle portion. The cord is connected to the legs of the male portion, so that pulling on the cord forces the male legs toward each other and out of the locking slots of the female portion. While this buckle device allows for quick release, there are situations where a cord might not be useful and a different type of quick release is required. In particular, when a user is in a restricted space, a cord pull might inadvertently catch on something, causing the buckle to release unexpectedly. For example, on a tactical vest worn by the military and law enforcement, crawling in a restricted space can cause the cord pull to catch on branches, roots or rocks that are on the ground. It is desirable to develop a buckle that can be easily released in restricted environments but that cannot be inadvertently released by catching on objects in the environment.

SUMMARY OF THE INVENTION

It is therefore an object of the invention to provide a quick-release buckle system that can be used on articles of that need to be quickly unlocked, and which does not require the user to pull on a cord.

This and other objects are achieved by a quick release buckle assembly having a male portion that is inserted into a female portion. Each female portion comprises a hollow body with a front wall, a back wall, an open top, a cavity between the front and back walls and at least one locking slot extending through the hollow body and communicating with the cavity. Each male portion comprises a base with at least one locking leg, such that inserting the male part into the open top of the female part causes the locking leg to engage the locking slot to lock the male portion to the female portion, as is the case with traditional side-release buckles. In a preferred embodiment, each male portion has two locking arms and each female portion has two locking slots. The male portion also can be released in the traditional manner: by pinching the locking legs together until they clear the locking slots in the female portion. However, the buckle used in the present invention has an additional feature. In this buckle, there are additional means for moving the locking leg inward to release the male portion from the female portion.

The means for moving the locking leg toward the central leg can comprise a lever pivotably connected at one end to the male portion. The lever has a free end with a tongue extending into an interior of the male portion. The male portion has an engaging element connected to a free end of the locking legs and contacting the tongue, so that lifting the free end of the lever causes the tongue to push the engaging element toward the base of the male portion and move the locking legs inward to release the male portion from the female portion.

In one embodiment, the base of the male portion is hollow with a bottom and two side walls, and the lever forms a top surface of the base. The lever is connected to the base by being mounted in a hole in each of the side walls of the base. The lever pivots around prongs that extend through the holes to keep the lever connected to the base.

In one embodiment, the engaging element is a hollow member, and the tongue extends through the hole in the hollow member. Alternatively, the engaging element can be a correspondingly shaped tongue that engages with the tongue on the lever. Alternative structures could also be used.

The locking legs can be connected to the engaging element via integrally molded bars extending from a free end of the locking legs to the engaging element.

In another embodiment, there is a central leg disposed between the locking legs and connected to the engaging element. The locking legs are connected to the central leg so that moving the engaging element pulls the central leg toward the base of the male portion and moves the locking legs toward each other.

The male portion can have means on the base for attaching an object to the male portion. In one embodiment, this means is a plate extending from the base. There is an aperture extending through the plate for attachment of various devices. Other attachment means can also be used, such as bars for securing straps. Any suitable attachment mechanism can be used.

The present invention is ideal for use in locations when only a small quick movement is require to unlock the buckle. With the present invention, all that is required is for the lever to be lifted in order to release the buckle. This requires only a few centimeters of movement with the user's fingers, rather than a whole arm motion as with the cable pulls of the prior art.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
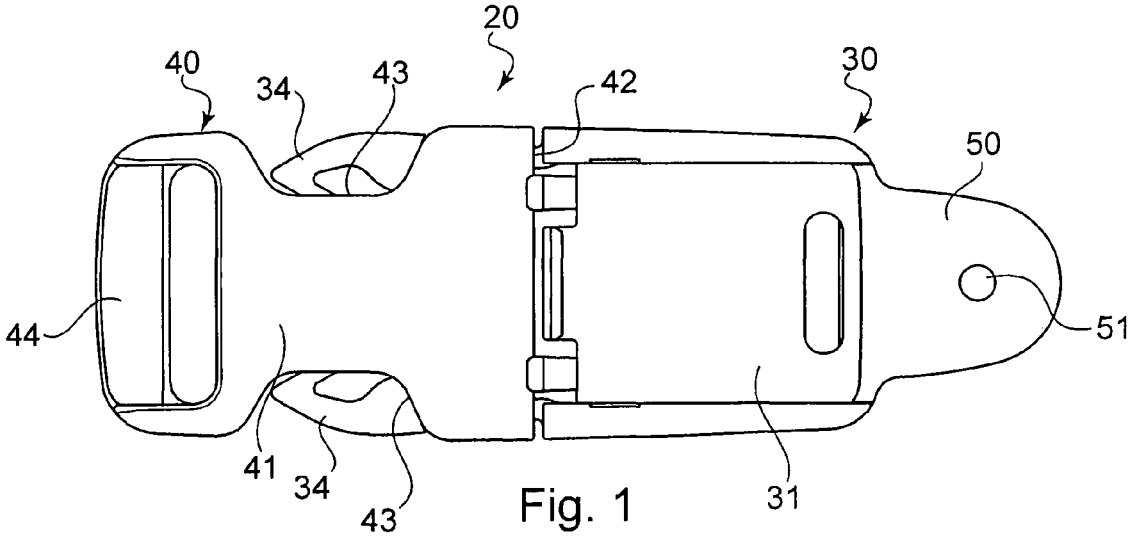
FIG. 1 is a top view of one embodiment of the buckle assembly according to the invention.
Figure 4:
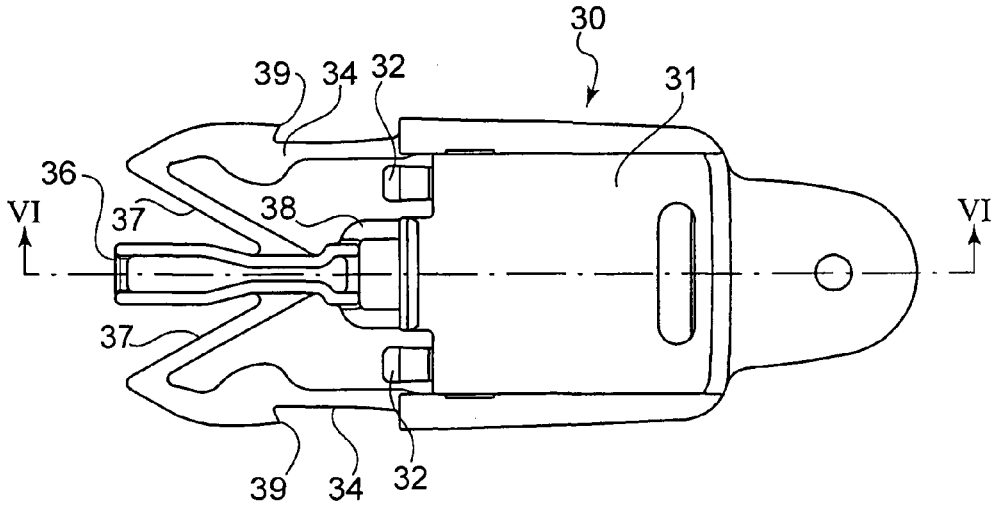
FIG. 4 is a top view of the male portion.
Figure 2:
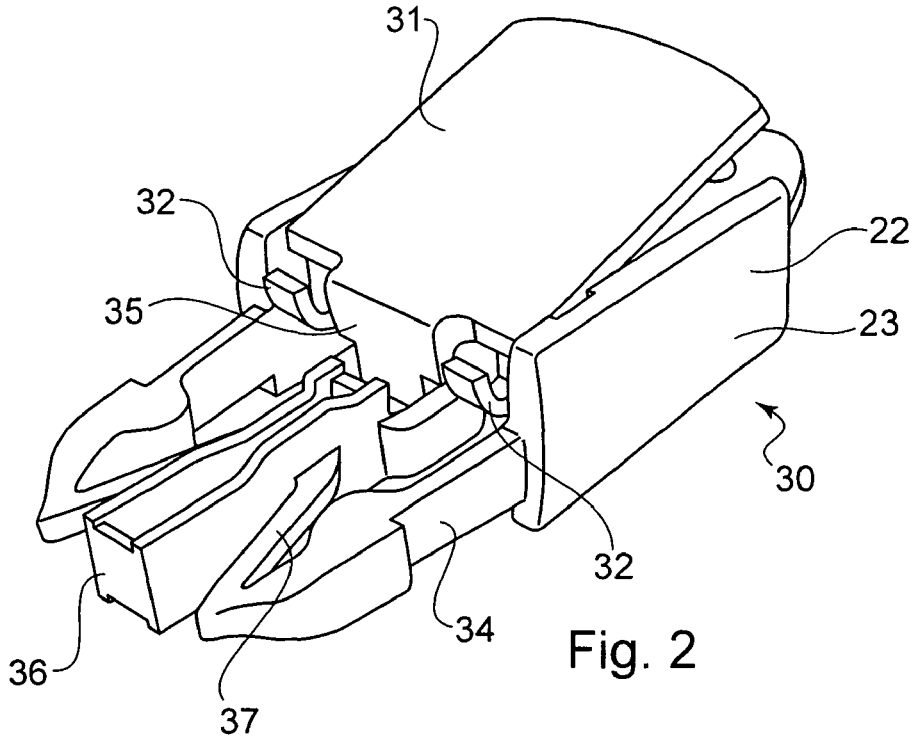
FIG. 2 is a top perspective view of the male portion shown in FIG. 1.
Figure 3:
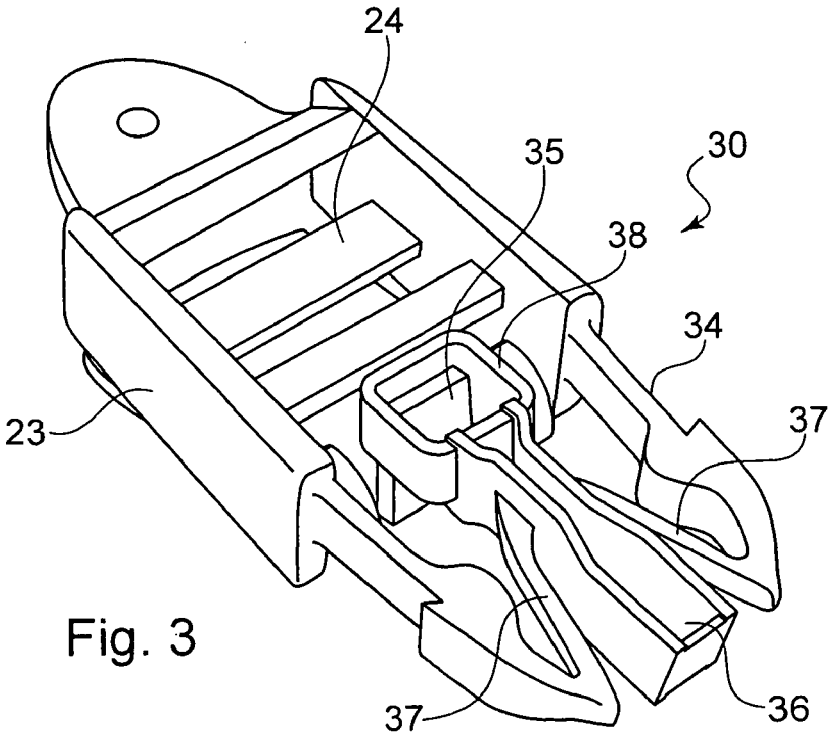
FIG. 3 is a bottom perspective view of the male portion of FIG. 2.
Figure 5:
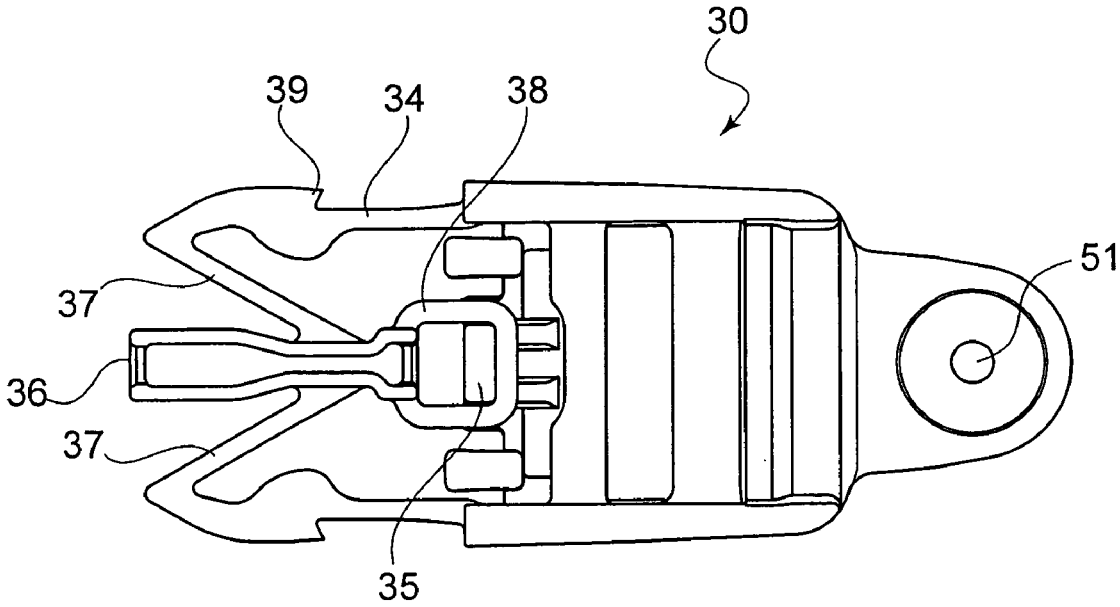
FIG. 5 is a is a bottom view of the male portion.
Figure 6:
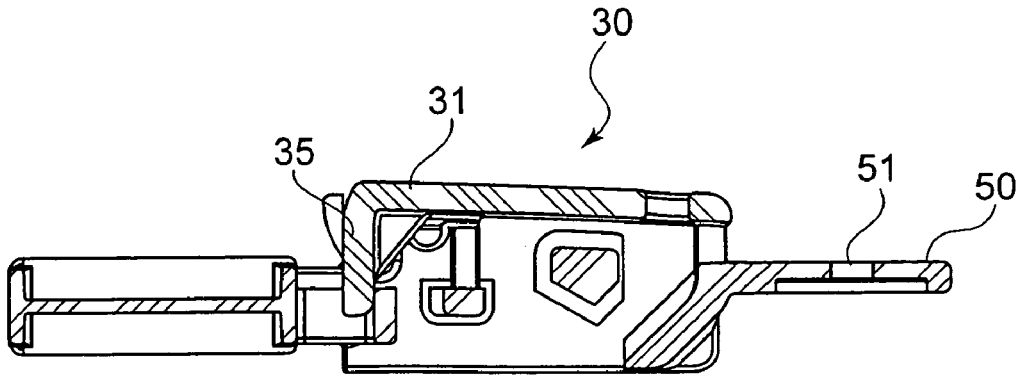
FIG. 6 is a side cross-sectional view along lines VI-VI of FIG. 4, showing the buckle in a locked, resting position.
Figure 7:
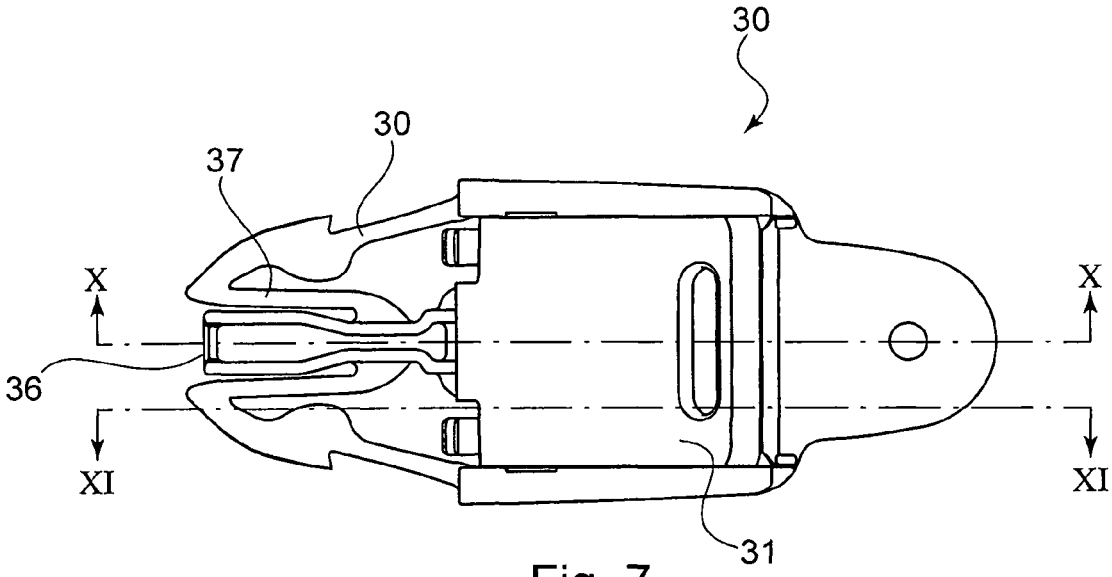
FIG. 7 is a top view of the male portion, showing the lever being lifted to pull the locking legs into a release position.
Figure 8:
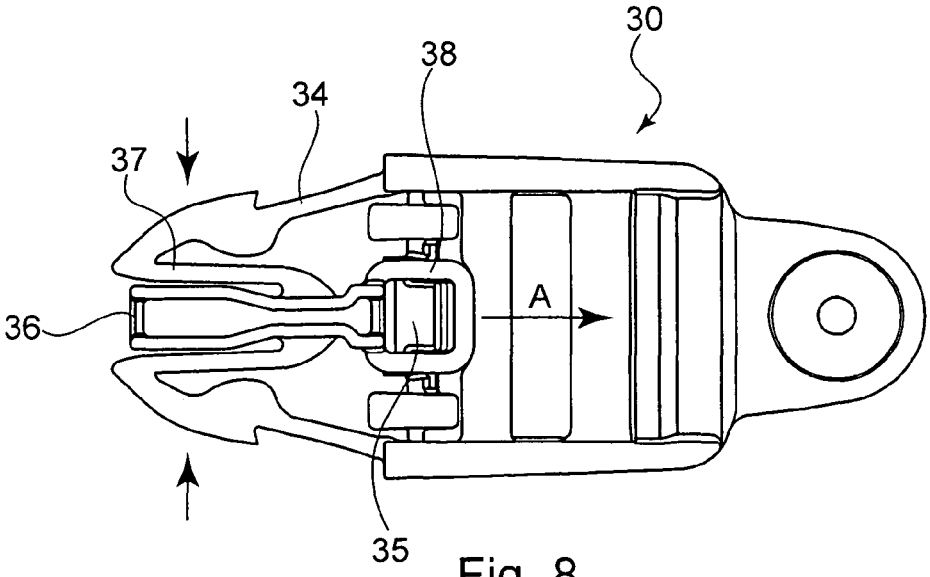
FIG. 8 is a bottom view of the male portion of FIG. 7.
Figure 9:
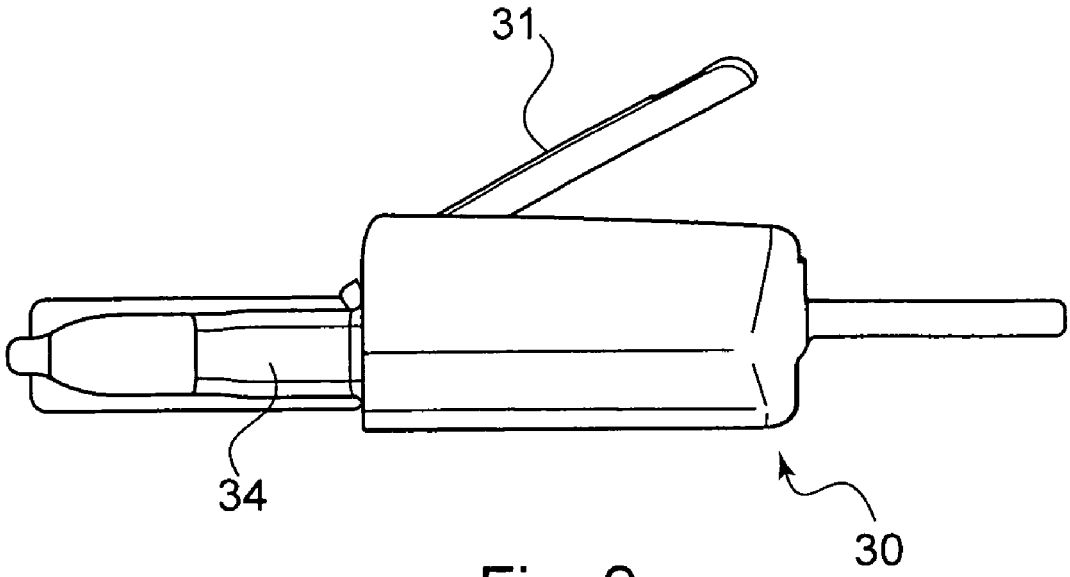
FIG. 9 is a side view of the male portion of FIG. 7.
Figure 10:
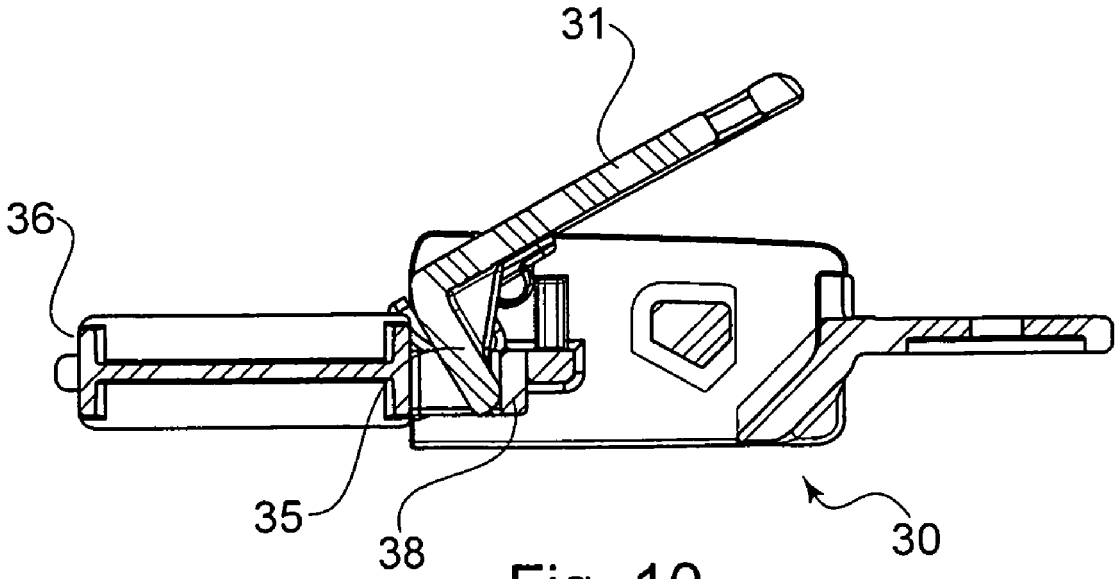
FIG. 10 is a cross-sectional view along lines X-X of FIG. 7.
Figure 11:
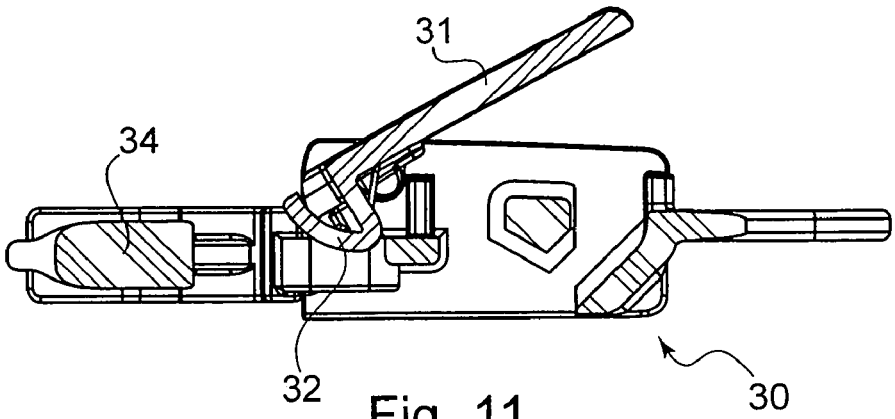
FIG. 11 is a cross-sectional view along lines XI-XI of FIG. 7.

Referring now in detail to the drawings, FIG. 1 shows a buckle assembly 20, which consists of a male buckle portion 30 connected to a female buckle portion 40. Female buckle portion 40 has a hollow main body 41 having a cavity with an open top 42 and two side slots 43, which accommodate locking legs 34 of male portion 30 when male portion 30 is inserted into open top 42 of female portion 40. The inserted section of male portion 30 has an overall width that is greater than the width of female portion 40 in the area of the locking slots, so that once male portion 30 is inserted through female portion 40, locking legs 34 snap into slots 43 to lock male portion 30 into female portion 40. Locking legs 34 have a stop 39, which prevents locking legs 34 from exiting slots 43 and inadvertently releasing male portion 30 from female portion 40 under minor tension. Male buckle portion 30 can be released from female buckle portion 40 by squeezing the tops of locking legs 34 together until stops 39 clear locking slots 43. However, in this buckle, male portion 30 also has a quick release function that can release male portion 30 from female portion 40 using a different release mechanism.

As shown in FIGS. 2-6, male portion 30 has a base 22 formed by side walls 23 and a bottom 24, and a pivotable lever 31 forming the top of base 22. Lever 31 is pivotably attached on male portion 30. Lever 31 has a tongue 35 extending into an interior of male portion 30. Tongue 35 contacts engaging element 38, which is connected via central leg 36 and arms 37 to locking legs 34. Engaging element 38 is formed as a hollow member with an aperture through which tongue 35 extends. Other configurations, such as an interlocking tongue, could also be used. Engaging element 38 can take any form, as long as it provides a surface for tongue 35 to press against when lever 31 is lifted.

Figure 12:
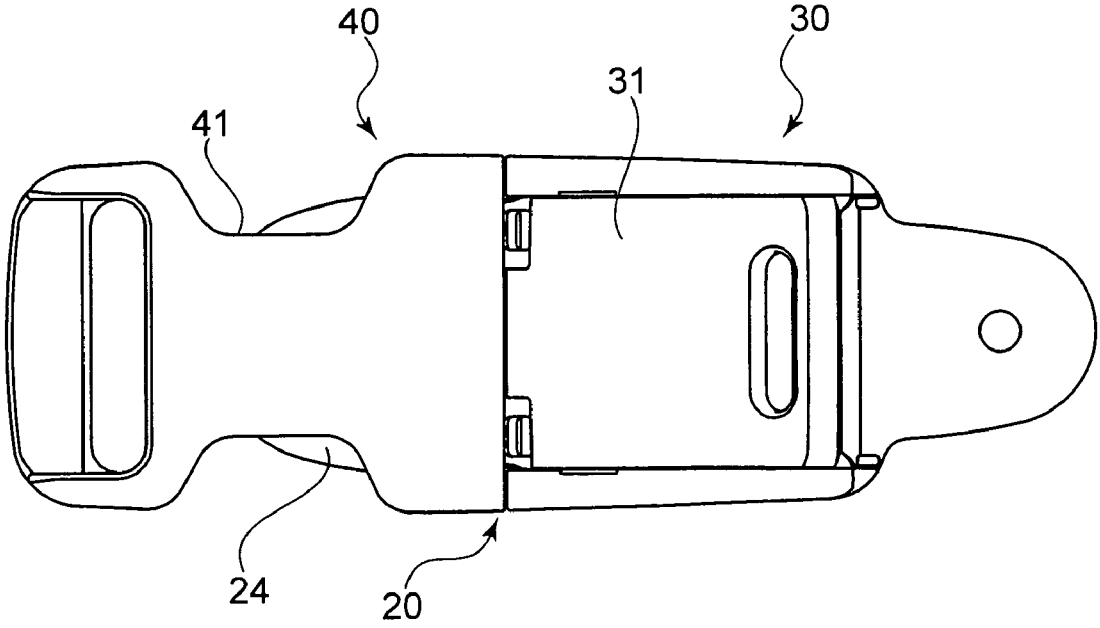
FIG. 12 is a top view of the entire buckle assembly in a release position.

To release locking legs 34 from male buckle portion 40, the user lifts lever 31 upward, as shown in FIGS. 7-12. This causes tongue 35 to press against engaging element 38 in such a way as to move engaging element rearward, i.e., in the direction of arrow A shown in FIG. 8. This rearward motion pulls central leg 36 and arms 37 rearward as well, causing locking legs 34 to be pulled inward. Lifting lever 31 up to a sufficient extent pulls locking legs 34 inward enough so that they clear locking slots 41 on female portion 40, as shown in FIG. 12. Hooks 32 on male portion 30 act to push male portion 30 out of female portion 20 when locking legs 34 are released.

This mechanism is very useful in the event that the user needs to release the buckle assembly very quickly. A quick pull upward on the lever releases the male portion from the female portion. This often much faster and easier than trying to locate the tips of the locking legs and squeezing them together, especially if the user is in very tight quarters, for example when crawling along the ground in a military maneuver.

The buckle assembly according to the invention is useful for attaching objects to an article of clothing, or to another object. In the embodiment shown in the drawing, objects can be attached to the male portion by connecting them through hole 51 in plate 50, which is attached to male portion 30, as shown in FIG. 1. A strap securing bar 44 is attached to female portion 40 to connect female portion 40 to a second object or article of clothing.

Accordingly, while only a few embodiments of the present invention have been shown and described, it is obvious that many changes and modifications may be made thereunto without departing from the spirit and scope of the invention.

What is claimed is:

1. A quick-release buckle assembly, comprising:

a female portion comprising a hollow body with an interior cavity, an open top communicating with the cavity, and at least one locking slot extending through the hollow body and communicating with the cavity;

a male portion comprising a base, and at least one locking leg, such that inserting the male portion into the cavity through the open top of the female portion causes the at least one locking leg to engage the at least one locking slot to lock the male portion to the female portion; and a lever pivotably connected at one end to the male portion and having a free end, said lever having a tongue extending into an interior of the male portion;

wherein the male portion has an engaging element connected to a free end of the at least one locking leg, and wherein the tongue contacts the engaging element, so that lifting the free end of the lever causes the tongue to push the engaging element toward the base of the male portion and move the at least one locking leg inward to release the male portion from the female portion.

2. The buckle assembly according to claim 1, wherein the male portion has two locking legs and the female portion has two locking slots, and wherein both locking legs are connected to the engaging element.

3. The buckle assembly according to claim 2, wherein the base of the male portion is hollow with a bottom and two side walls, wherein the lever forms a top surface of the base, and wherein the lever is pivotably mounted to the base.

4. The buckle assembly according to claim 2, wherein the locking legs are connected to the engaging element via arms extending from a free end of the locking legs to a central leg, which is connected to the engaging element.

5. The buckle assembly according to claim 1, wherein the engaging element is a hollow member, and wherein the tongue extends through the hollow member.

6. The buckle assembly according to claim 1, wherein the base further comprises means for attaching an object to the male portion.

7. The buckle assembly according to claim 1, wherein the means for attaching an object to the male portion comprises a plate extending from the base, said plate having an aperture extending through the plate.

* * * * *